US010391541B2

(12) United States Patent
Lee

(10) Patent No.: US 10,391,541 B2
(45) Date of Patent: Aug. 27, 2019

(54) RECIRCULATION SYSTEMS AND METHODS FOR CAN AND BOTTLE MAKING MACHINERY

(71) Applicant: BELVAC PRODUCTION MACHINERY, INC., Lynchburg, VA (US)

(72) Inventor: Richard H. Lee, Forest, VA (US)

(73) Assignee: BELVAC PRODUCTION MACHINERY, INC., Lynchburg, VA (US)

( * ) Notice: Subject to any disclaimer, the term of this patent is extended or adjusted under 35 U.S.C. 154(b) by 0 days.

(21) Appl. No.: 15/120,929

(22) PCT Filed: Feb. 27, 2015

(86) PCT No.: PCT/US2015/018119

§ 371 (c)(1),
(2) Date: Aug. 23, 2016

(87) PCT Pub. No.: WO2015/131114

PCT Pub. Date: Sep. 3, 2015

(65) Prior Publication Data

US 2016/0361750 A1 Dec. 15, 2016

Related U.S. Application Data

(60) Provisional application No. 61/945,634, filed on Feb. 27, 2014.

(51) Int. Cl.
*B21D 51/26* (2006.01)

(52) U.S. Cl.
CPC ..... *B21D 51/2692* (2013.01)

(58) Field of Classification Search
CPC ..... B21D 51/26; B21D 51/2692
See application file for complete search history.

(56) References Cited

U.S. PATENT DOCUMENTS 1,673,236 A 6/1928 Fleisher
3,378,285 A 4/1968 Staley
(Continued)

FOREIGN PATENT DOCUMENTS

CN 101142040 3/2008
CN 102574193 7/2012
(Continued)

OTHER PUBLICATIONS

Machine translation of JP 2002-102968A, Hanabusa et al., pp. 1-8, translated on Apr. 19, 2018.*
(Continued)

*Primary Examiner* — Teresa M Ekiert
(74) *Attorney, Agent, or Firm* — Nixon Peabody LLP

(57) ABSTRACT

Systems and methods for performing multiple recirculations of a plurality of articles are disclosed. A system includes a plurality of line starwheels and a recirculation line. The plurality of line starwheels each include a plurality of starwheel pockets thereon. The plurality of starwheel pockets includes a first-pass, a second-pass, and a third-pass starwheel pocket. The recirculation line includes a synchronization mechanism and a plurality of line-pocket sets. Each of the line-pocket sets includes a first and a second line pocket. The line pockets are configured to receive an article from a downstream line starwheel and deposit the article in the proper starwheel pocket of an upstream line starwheel. The synchronization mechanism configured to synchronize the plurality of line-pocket sets to the plurality of starwheel pockets. The first-pass, second-pass, and third-pass starwheel pockets correspond with respective first, second, and third stages of modifying the article.

23 Claims, 3 Drawing Sheets

(56) References Cited

U.S. PATENT DOCUMENTS

| | | | |
|---|---|---|---|
| 3,418,837 | A | 12/1968 | Vanderlaan et al. |
| 3,581,542 | A | 6/1971 | Wahler et al. |
| 3,797,429 | A | 3/1974 | Wolfe |
| 3,913,366 | A | 10/1975 | Nelsen et al. |
| 3,983,729 | A | 10/1976 | Traczyk et al. |
| 4,278,711 | A | 7/1981 | Sullivan |
| 4,402,202 | A | 9/1983 | Gombas |
| 4,446,714 | A | 5/1984 | Cvacho |
| 4,513,595 | A | 4/1985 | Cvacho |
| 4,519,232 | A | 5/1985 | Traczyk et al. |
| 4,547,645 | A | 10/1985 | Smith |
| 4,671,093 | A | 6/1987 | Dominica et al. |
| 4,697,414 | A | 10/1987 | McCarty |
| 4,774,839 | A | 10/1988 | Caleffi et al. |
| 4,808,053 | A | 2/1989 | Nagai et al. |
| 4,824,303 | A | 4/1989 | Dinger |
| H000906 | H | 4/1991 | Baggett et al. |
| 5,209,101 | A | 5/1993 | Finzer |
| 5,220,993 | A | 6/1993 | Scarpa et al. |
| 5,242,497 | A | 9/1993 | Miller et al. |
| 5,249,449 | A | 10/1993 | Lee et al. |
| 5,282,375 | A | 2/1994 | Lee, Jr. et al. |
| 5,344,252 | A | 9/1994 | Kakimoto |
| 5,497,900 | A | 3/1996 | Caleffi et al. |
| 5,555,756 | A | 9/1996 | Fischer et al. |
| 5,590,558 | A | 1/1997 | Saunders et al. |
| 5,611,231 | A | 3/1997 | Marritt et al. |
| 5,676,006 | A | 10/1997 | Marshall |
| 5,718,030 | A | 2/1998 | Langmack et al. |
| 5,755,130 | A | 5/1998 | Tung et al. |
| 5,768,931 | A | 6/1998 | Gombas |
| 5,771,807 | A | 6/1998 | Moss |
| 5,832,769 | A | 11/1998 | Schultz |
| 6,220,138 | B1 | 4/2001 | Sakamoto |
| 6,622,379 | B1 | 9/2003 | Kano |
| 6,637,247 | B2 | 10/2003 | Bowlin |
| 6,874,971 | B2 | 4/2005 | Albaugh |
| 7,219,790 | B2 | 5/2007 | Lanfranchi |
| 7,263,867 | B2 | 9/2007 | Bartosch et al. |
| 7,310,983 | B2 | 12/2007 | Schill et al. |
| 7,387,007 | B2 | 6/2008 | Schill et al. |
| 7,404,309 | B2 | 7/2008 | Schill et al. |
| 7,409,845 | B2 | 8/2008 | Schill et al. |
| 7,418,852 | B2 | 9/2008 | Schill et al. |
| 7,454,944 | B2 | 11/2008 | Schill et al. |
| 7,464,573 | B2 | 12/2008 | Shortridge |
| 7,530,445 | B2 | 5/2009 | Marshall et al. |
| 7,568,573 | B2 | 8/2009 | Schill |
| 7,770,425 | B2 | 8/2010 | Egerton et al. |
| 7,784,319 | B2 | 8/2010 | Saville |
| 7,805,970 | B2 | 10/2010 | Woulds |
| 7,818,987 | B2 | 10/2010 | Marshall et al. |
| 7,886,894 | B2 | 2/2011 | Schill et al. |
| 7,905,130 | B2 | 3/2011 | Marshall et al. |
| 7,942,256 | B2 | 5/2011 | Coates |
| 7,997,111 | B2 | 8/2011 | Mercer et al. |
| 8,066,115 | B2 | 11/2011 | Frattini |
| 8,245,551 | B2 | 8/2012 | Egerton |
| 8,733,146 | B2 | 5/2014 | Babbitt et al. |
| 9,027,733 | B2 | 5/2015 | Coates |
| 9,095,888 | B2 | 8/2015 | Babbitt et al. |
| 2003/0063949 | A1 | 4/2003 | Hohenocker |
| 2005/0193796 | A1 | 9/2005 | Heiberger |
| 2006/0101885 | A1 | 5/2006 | Schill et al. |
| 2006/0101889 | A1 | 5/2006 | Schill et al. |
| 2007/0227859 | A1 | 10/2007 | Marshall et al. |
| 2007/0266755 | A1 | 11/2007 | Cook et al. |
| 2008/0282758 | A1 | 11/2008 | Shortridge et al. |
| 2009/0266128 | A1 | 10/2009 | Mercer et al. |
| 2009/0266130 | A1 | 10/2009 | Saville |
| 2010/0092266 | A1 | 4/2010 | Matsuo et al. |
| 2010/0095725 | A1 | 4/2010 | Sanginiti et al. |
| 2010/0116622 | A1 | 5/2010 | Schill et al. |
| 2010/0212130 | A1 | 8/2010 | Marshall |
| 2010/0212385 | A1 | 8/2010 | Marshall |
| 2010/0212390 | A1 | 8/2010 | Marshall et al. |
| 2010/0212393 | A1 | 8/2010 | Babbitt et al. |
| 2010/0213030 | A1 | 8/2010 | Green |
| 2010/0213677 | A1 | 8/2010 | Marshall |
| 2011/0108389 | A1 | 5/2011 | Bonnain |

FOREIGN PATENT DOCUMENTS

| | | | |
|---|---|---|---|
| DE | 3705878 | A1 | 9/1987 |
| DE | 3908394 | C1 | 12/1989 |
| DE | 4023771 | A1 | 1/1992 |
| DE | 10319302 | B3 | 8/2004 |
| EP | 0384427 | A1 | 8/1990 |
| EP | 1215430 | A1 | 6/2002 |
| EP | 1714939 | A1 | 10/2006 |
| GB | 023528 | | 12/1910 |
| GB | 1042506 | A | 9/1966 |
| JP | 05038476 | A | 2/1993 |
| JP | 2002 102968 | A | 4/2002 |
| JP | 2002-310178 | A | 10/2002 |
| JP | 2005-329434 | A | 12/2005 |
| JP | 2011-500333 | A | 1/2011 |
| JP | 2013-522046 | A | 6/2013 |
| WO | 8805700 | A1 | 8/1988 |
| WO | 9011839 | A1 | 10/1990 |
| WO | 9633032 | A1 | 10/1996 |
| WO | 9737786 | A1 | 10/1997 |
| WO | 9819807 | A1 | 5/1998 |
| WO | 0190591 | A1 | 11/2001 |
| WO | 2006055185 | A1 | 5/2006 |
| WO | 2008111552 | A1 | 9/2008 |
| WO | 2009/054012 | A1 | 4/2009 |
| WO | 2010099067 | A1 | 9/2010 |
| WO | 2010099069 | A1 | 9/2010 |
| WO | 2010099081 | A1 | 9/2010 |
| WO | 2010099082 | A1 | 9/2010 |
| WO | 2010099165 | A2 | 9/2010 |
| WO | 2010099171 | A1 | 9/2010 |
| WO | 2015131114 | A1 | 9/2015 |

OTHER PUBLICATIONS

American National Can Company; Invoice to Hanil Can Co., Ltd. dated Feb. 2, 1998; 1 page.

American National Can Company; Drawings showing commercially available 5811-12 necker machine and Parts List; Oct. 1993; 4 pages.

American National Can Company; Extracts from brochure: 5811/5811-2 Necker Flanger Reformer—Periodic Inspection and Maintenance Procedures; Apr. 22, 1994; 9 pages.

American National Can Company; Extracts from brochure: ANC Necker Secrets Revealed; 1996; 3 pages.

International Search Report and Written Opinion from International Application No. PCT/US2015/018119 dated May 8, 2015.

Translation of Notice of Reasons for Rejection from Japanese Application No. 2016-554354, dated Jan. 28, 2019.

* cited by examiner

RECIRCULATION SYSTEMS AND METHODS FOR CAN AND BOTTLE MAKING MACHINERY

CROSS-REFERENCE TO RELATED APPLICATIONS

This application claims the benefit of U.S. Provisional Application No. 61/945,634, filed Feb. 27, 2014, which is hereby incorporated by reference in its entirety.

FIELD OF THE INVENTION

The present disclosure relates generally to manufacturing articles such as beverage containers, and more particularly, to systems and methods for recirculating metal containers during manufacturing to reduce the amount of machinery needed for processing.

BACKGROUND

Conventional machine arrangements for bottle and can manufacturing are typically linear and are generally referred to as machine lines. That is, the machine lines, with each and every processing and/or forming machine, extend in a single line. The articles are passed through the machine line only once to achieve a desired stage of manufacture. Such a "single-pass" arrangement may take up a large amount of space in a warehouse, factory, or other location. Occasionally, buildings are not large enough or long enough to house such complex and long machine arrangements. For example, in bottle or can operations, many different types of processes need to be performed on the bottle or can, such as necking, curling, expansion, trimming, etc. Each type of process may also require a plurality of machines in order to sufficiently perform the necessary process. For instance, necking operations may require multiple operations with multiple machines in order to properly neck a bottle or can that is of a certain length or size. A downside of the conventional single-pass arrangement is that the machine lines may need to include duplicate or additional machines in order to perform the desired function(s), increasing both the cost and footprint of these machines.

Machine arrangements have been developed that perform a single recirculation of cans or bottles. Such an arrangement takes cans or bottles from a downstream point after the cans or bottles have passed through the machine line once and transports the cans or bottles upstream for a second pass through the machine line. That is, each processing or forming machine in the machine line receives cans or bottles at two different stages of manufacturing. On the first pass through the machine line, each machine performs a first operation on the cans or bottles. These operations result in cans or bottles at a single stage of manufacture. These cans or bottles are then recirculated for a second pass through the machine line. On the second pass, each machine performs a second operation on the can or bottle, resulting in a can or bottle at the desired stage of manufacture. The can or bottle is then output from the machine line and passed downstream for packaging or further processing. These machine arrangements achieve the same number of required process stages with as little as half the number of line starwheels versus a single-pass counterpart. This results in a generally lower-cost machine with a generally smaller footprint, but sacrifices throughput of the machine. In such a two-pass system, the cans or bottles received by the recirculator are always at the same stage of manufacture. Such systems are non-synchronous. The non-synchronous nature of such a system can prevent performance of more than one recirculation because the cans or bottles may be placed in the wrong position for recirculation. Such improper placement can result in collisions, jams, and/or non-uniform products being delivered downstream from the system.

Thus, a need exists for systems and methods for performing multiple recirculations of containers to achieve a desired stage of manufacture while lowering system costs and/or space occupied by the system.

BRIEF SUMMARY

According to some aspects of the present disclosure, a system for modifying articles received from an infeed includes a plurality of line starwheels and a recirculation line. The plurality of line starwheels are cooperatively arranged to form a process line. Each of the plurality of line starwheels includes a plurality of starwheel pockets thereon. The plurality of starwheel pockets includes a first-pass starwheel pocket, a second-pass starwheel pocket, and a third-pass starwheel pocket. The recirculation line includes a synchronization mechanism and a plurality of line-pocket sets. Each of the plurality of line-pocket sets including a first line pocket and a second line pocket. The first line pocket is configured to receive an article from the first-pass starwheel pocket of a downstream line starwheel and deposit the article in the second-pass starwheel pocket of an upstream line starwheel. The second line pocket is configured to receive the article from the second-pass starwheel pocket of the downstream line starwheel and deposit the article in the third-pass starwheel pocket of the upstream line starwheel. The synchronization mechanism configured to synchronize the plurality of line-pocket sets to the plurality of starwheel pockets. The article contacting the first-pass starwheel pockets, the second-pass starwheel pockets, and the third-pass starwheel pockets corresponds with a respective first stage, second stage, and third stage of modifying the article.

According to further aspects of the present disclosure, a method of modifying articles includes providing an article to be modified to a plurality of line starwheels, modifying the article to form a first-pass article, transferring the first-pass article from a first-pass starwheel pocket of a downstream line starwheel to a second-pass starwheel pocket of an upstream line starwheel, modifying the first-pass article to form a second-pass article, transferring the second-pass article from the second-pass starwheel pocket of the downstream line starwheel to a third-pass starwheel pocket of the upstream line starwheel, and tensioning a working side and a return side of the recirculation line. Each of the plurality of line starwheels includes a plurality of starwheel pockets thereon. The plurality of starwheel pockets includes the first-pass starwheel pocket, the second-pass starwheel pocket, and the third-pass starwheel pocket. The modifying the article to form a first-pass article is performed using the first-pass starwheel pocket of at least one of the line starwheels. The transferring the first-pass article is performed using a first line pocket of a recirculation line. The first-pass article travels along a path defining the working side of the recirculation line. The modifying the first-pass article to form a second-pass article is performed using the second-pass starwheel pocket of at least one of the line starwheels. The transferring the second-pass article is performed using a second line pocket of the recirculation line. The second-pass article travels along the working side of the recirculation line. The tensioning the working side of the recirculation line is performed using a takeup mechanism.

According to yet further aspects of the present disclosure, a system for modifying articles includes an infeed starwheel, one or more line starwheels, a recirculation line, and an outfeed starwheel. The infeed starwheel is configured to supply preformed articles at regular intervals. Each of the one or more line starwheels includes a plurality of starwheel pockets thereon. The one or more line starwheels also includes a first pocket, a second pocket, and a third pocket. The first pocket is configured to receive the preformed articles from the infeed starwheel and perform a first modification producing first-pass articles. The second pocket is configured to receive the first-pass articles and perform a second modification producing second-pass articles. The third pocket is configured to receive the second-pass articles and perform a third modification creating third-pass articles. The recirculation line is configured to receive the first-pass articles and the second-pass articles and to transport the first-pass articles and the second-pass articles. Each of the first-pass articles and the second-pass articles is phase shifted during transport. The outfeed starwheel is configured to remove completed articles from one of the one or more line starwheels at regular intervals. Each of the completed articles has been modified by the first pocket, the second pocket, and the third pocket.

Figure 1:
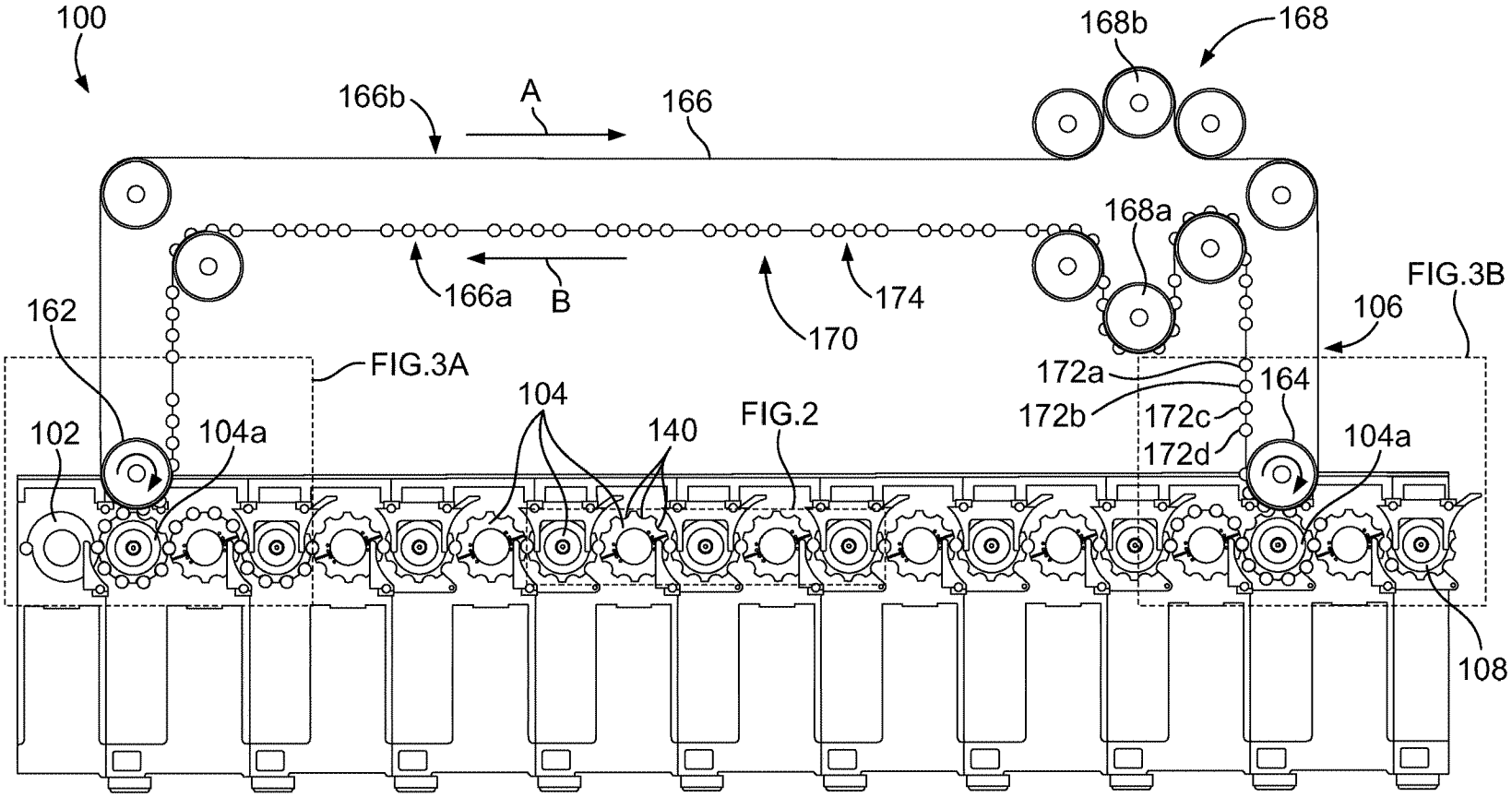
FIG. 1 illustrates a schematic view of an example system having a recirculation line for performing multiple recirculations of metal containers, according to an embodiment.

While the invention is susceptible to various modifications and alternative forms, a specific embodiment thereof has been shown by way of example in the drawings and will herein be described in detail. It should be understood, however, that it is not intended to limit the invention to the particular forms disclosed, but, on the contrary, the intention is to cover all modifications, equivalents, and alternatives falling within the spirit and scope of the invention.

DETAILED DESCRIPTION

Aspects of the present invention address the problem of recirculating articles at varying stages of manufacture using a single recirculation line. In particular, the recirculation line includes a plurality of pockets, each being configured to receive an article at a particular, different stage of manufacture. The recirculation line is synchronized with the machine line so that each received article is transported to the correct pocket when recirculated through the machine line. Advantageously, this allows the manufacturing of containers to occur with fewer line starwheels, resulting in a generally lower cost machine with a smaller footprint than a single- or two-pass machine.

Figure 2:
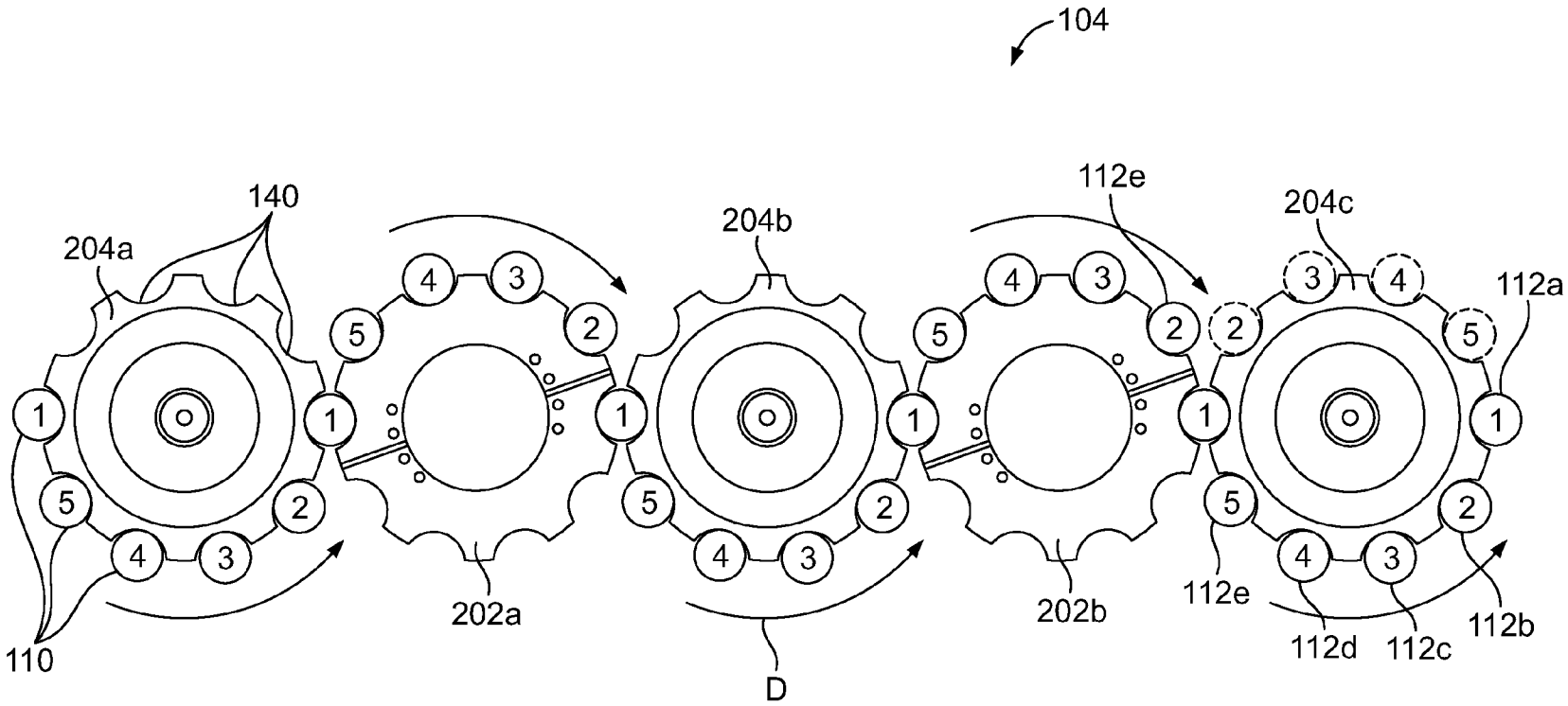
FIG. 2 illustrates a schematic view of line starwheels from a portion of the example system of FIG. 1.
Figures 3A, 3B:
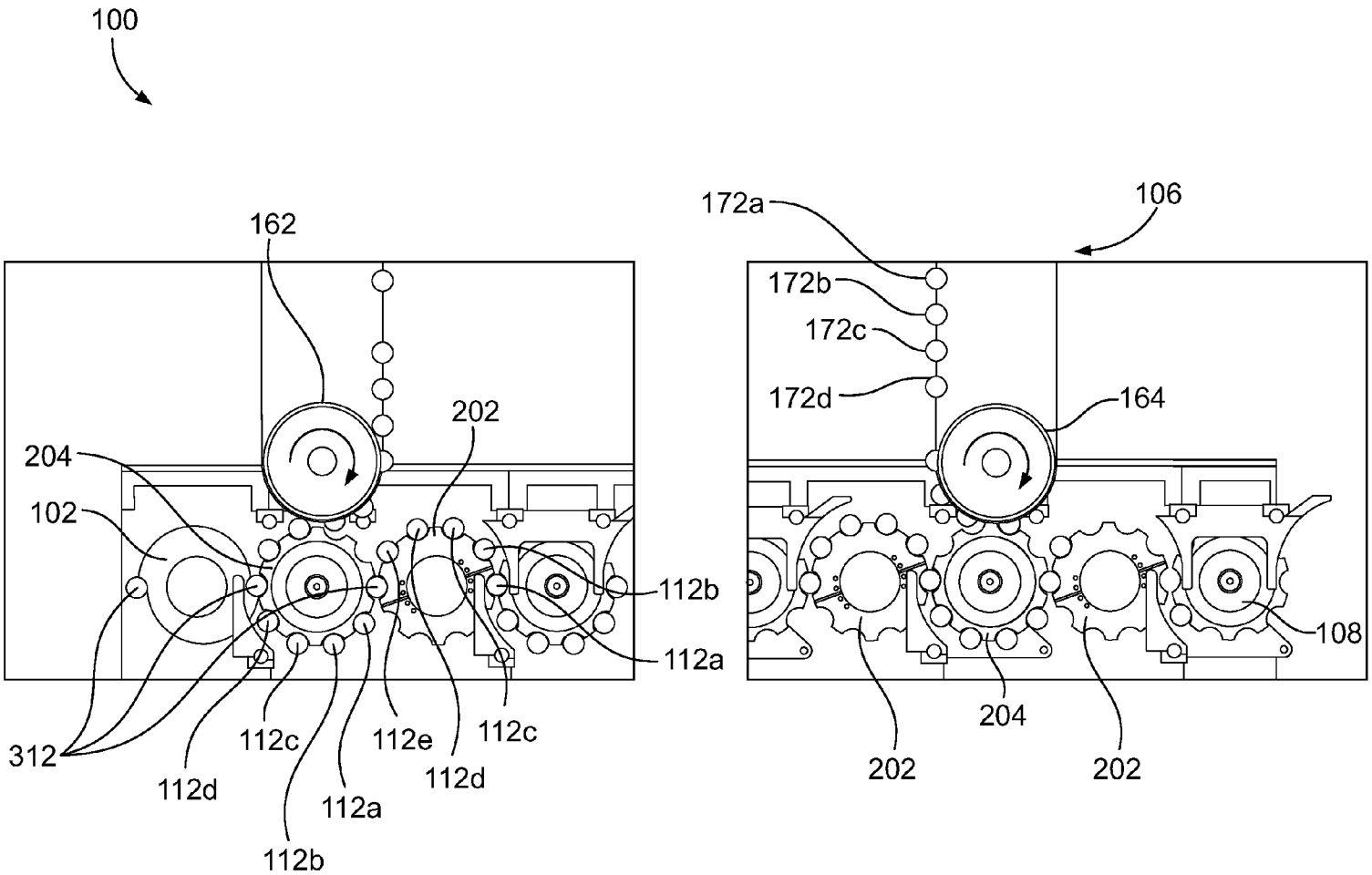
FIG. 3 illustrates an expanded view of the interfaces between line starwheels and a recirculation line within the example system of FIG. 1.

FIGS. 1-3 illustrate a system 100 for forming articles 110. The articles 110 may be cans, any suitable food or beverage containers, jars, bottles or any other suitable articles of manufacture. The articles may be formed of a metal, metal alloy, polymers, any other suitable material, or combinations thereof. Each of the articles 110 has an open end opposite a closed end and at least one sidewall bridging the open end and the closed end. Alternatively, each of the articles 110 may be open at both ends or closed at both ends. A top, lid, or other closure may be added to the articles 110 during an operation by the system 100 or at a later stage.

Referring now to FIG. 1, the system 100 includes an infeed starwheel 102, a plurality of line starwheels 104, a recirculation line 106, and an outfeed starwheel 108. The infeed starwheel 102 receives articles 110 to be formed and supplies the articles 110 to the line starwheels 104 at regular intervals. In the illustrated example, the infeed starwheel 102 supplies the articles 110 to the line starwheels 104 at a rate of one article 110 per half revolution.

The line starwheels 104 are cooperatively arranged to form a process line. Each of the line starwheels 104 includes a plurality of starwheel pockets 140 thereon. In the illustrated example, each line starwheel 104 includes ten starwheel pockets 140 disposed at generally regular intervals about its periphery. Each starwheel pocket 140 is configured to receive the articles 110 at a respective predetermined stage of manufacture.

The recirculation line 106 includes a head pulley 162, a tail pulley 164, a conveyor 166, and takeup mechanism 168. The conveyor 166 runs between the head pulley 162 and the tail pulley 164. The conveyor 166 has a working side 166*a* and a return side 166*b*. The working side 166*a* of the conveyor 166 travels from the tail pulley 164 to the head pulley 162 in a direction denoted by arrow B. The return side 166*b* of the conveyor 166 travels from the head pulley 162 to the tail pulley 164 in a direction denoted by arrow A. The conveyor 166 can be any mechanism suitable to move the articles from a first location to a second location, such as a chain, belt, or tabletop chain.

The conveyor 166 includes a plurality of line-pocket sets 170 disposed thereon. Each of the plurality of line-pocket sets 170 includes a plurality of individual line pockets 172*a-d*. Each of the line pockets 172*a-d* is configured to receive an article 110 at a predetermined stage of manufacture from a downstream line starwheel 104*d* and transport the received article 110 to an upstream line starwheel 104*u*. The line pockets 172*a-d* can include any suitable attachment for securing the articles to the conveyor 166 or inhibiting movement of the articles relative to the conveyor 166 including, but not limited to, vacuum suction attachments, friction-grip attachments, pin attachments, grasping attachments, tubes, cups, troughs, etc. In embodiments where the conveyor 166 employs, for example, a tabletop chain, the line pockets 172*a-d* may be a designated position on the tabletop chain. The tabletop chain can include protrusions such as projections, extensions, lugs, lips, etc. to help inhibit movement of the articles relative to the conveyor 166. In the illustrated embodiment, each article 110 passes through the line starwheels 104 five times before being passed downstream from the system 100 via the outfeed starwheel 108. That is, each article is recycled four times. To accomplish this, each line-pocket set 170 includes a first line pocket 172*a*, a second line pocket 172*b*, a third line pocket 172*c*, and a fourth line pocket 172*d*.

The conveyor 166 may be driven by the head pulley 162 and/or the tail pulley 164. The rotational speed of the head pulley 162 and/or the tail pulley 164 is selected to properly time each of the line pockets 172*a-d* with a respective one of the starwheel pockets 140 of the upstream and downstream starwheels 104*u, d* so that the articles 110 can be passed between the conveyor 166 and starwheels 104 without jamming. The rotation of the head pulley 162 is synchronized with the rotation of the upstream line starwheel 104*u* and the rotation of the tail pulley 164 is synchronized with the rotation of the downstream starwheel 104*d* using at least one synchronization mechanism (not shown). Because each of the starwheels in the machine line synchronously rotates, the rotation of the head pulley 162 and the tail pulley 164 is synchronized as well.

The synchronization mechanism can be any mechanism suitable to synchronize the rotation of the head pulley 162 with the upstream line starwheel 104*u* and the tail pulley 164 with the downstream starwheel 104*d*. In some aspects, mechanical linkages may be used to drive and synchronize the rotation of the head pulley 162 and the tail pulley 164. For example, the head pulley 162 is mechanically linked to the upstream line starwheel 104*u* using a geartrain or a timing chain and, similarly, the tail pulley 164 and the downstream starwheel 104*d* are mechanically linked using a geartrain or a timing chain. In some aspects, servo motors are used to both drive and synchronize the rotation of the head pulley 162 and the tail pulley 164. In some aspects, the conveyor 166 is driven by a pulley disposed on the working side 166*a* and/or the return side 166*b* of the conveyor 166. It is contemplated that the conveyor 166 may be used as the synchronization mechanism, for example, on shorter systems or systems that are designed to allow for slight variability in timing.

The line pockets 172*a-d* are spaced at regular intervals within the line-pocket set 170. In some aspects, the linear distance between adjacent line pockets 172*a-d* (e.g., pitch) is generally equal to the circumferential distance between adjacent starwheel pockets 140. Beneficially, the rotational speed of the head pulley 162 and the tail pulley 164 can be adjusted to compensate for distances between adjacent line pockets 172*a-d* that are either greater than or less than the circumferential distance between adjacent starwheel pockets 140. For example, commercially available belts or chain with line pocket 172*a-d* spacing that is different from the circumferential distance between adjacent starwheel pockets 140 can be used. Further, lot-to-lot variability in line pocket 172*a-d* spacing of commercially available belts or chains can also be accounted for by adjusting the rotational speed of the head pulley 162 and the tail pulley 164. Additionally, adjusting the rotational speed of the head pulley 162 and the tail pulley 164 allows for additional functionality in the recirculation line 106. For example, if the pitch of the conveyor 166 is greater than the pitch of the line starwheels 104, then the linear speed of the conveyor 166 will be greater than the linear speed of the line starwheels 104, and the line pockets 172*a-d* will "catch up" to the respective starwheel pocket 104 to transfer the article 110. Alternatively, if the pitch of the conveyor 166 is less than the pitch of the starwheel 104, then the linear speed of the conveyor 166 will be less than the linear speed of the line starwheels 104, and the starwheel pockets 140 will "catch up" to the respective line pocket 172*a-d* to transfer the article 110. This allows the line pockets 172*a-d* and respective starwheel pockets 140 to remain synchronized despite differences in pitch. Additionally, as discussed below, the takeup mechanism 168 can be used to adjust for dynamic changes in spacing between adjacent line pockets 172*a-d*, such as the dynamic changes due to heating or wear of the conveyor 166.

A gap 174 is disposed between each of the line-pocket sets 170. The gaps 174 space the fourth line pocket 172*d* of a first line-pocket set 170 a distance from the first line pocket 172*a* of a second line-pocket set 170. The distance is approximately twice the center-to-center distance of adjacent line pockets 172*a-d* within the same line-pocket set 170. The inclusion of gaps 174 compensates for a completed article being sent to the outfeed starwheel 108 instead of being recycled.

The takeup mechanism 168 tensions the conveyor 166 and may adjust the linear distance traveled by the working side 166*a* of the conveyor 166. This can be used to compensate for length or pitch variance due to temperature variations, manufacturing tolerances, lot-to-lot variability, section-to-section differences, wear, chain-tension stretch, etc. In the illustrated embodiment, the takeup mechanism 168 is a dual takeup mechanism where the first takeup idler 168*a* tensions the working side 166*a* of the conveyor 166 and the second takeup idler 168*b* tensions the return side 166*b* of the conveyor 166. In some embodiments, the takeup idlers 168*a,b* move linearly to tension the conveyor 166 (e.g., moving upward or downward in the illustrated embodiment). In some embodiments, the takeup idlers 168*a,b* are mounted to pivot about an axis to tension the conveyor 166. For example, takeup idler 168*a* can be disposed at a first end of an arm distal a pivot axis. As the arm and takeup idler 168*a* pivot about the axis, the takeup idler 168*a* adjusts the linear distance traveled by the conveyor 166 so as to increase or decrease tension on the conveyor 166. It is contemplated that the takeup mechanism 168 may be achieved with fewer or more than the illustrated number of pulleys or sprockets. For example, the recirculation line 106 can include only four pulleys, only six pulleys, or any other suitable number of pulleys.

When the line starwheels 104 are disposed in a generally straight-line arrangement and the recirculation line 106 transfers the articles 110 at the same relative orientation on the upstream and downstream line starwheels 104*u,d*, the recirculation line 106 must phase shift the articles 110. That is, the working side 166*a* of the conveyor 166 must travel a linear distance such that a line pocket 172*a-d* of a first line-pocket set 170 deposits an n-pass article 110 in the upstream line starwheel 104*u* while a line-pocket 172*a-d* of a second line-pocket set 170 receives an m-pass article 110 from the downstream line starwheels 104, where m=n+1. For example, the first line pocket 172*a* of a line-pocket set 170 disposed at the head pulley 162 deposits a first-pass article 112*a* in the second-pass starwheel pocket 140 of the upstream line starwheel 104*u* contemporaneously with the second line pocket 172*b* of a line-pocket set 170 disposed at the tail pulley 164 receiving a second-pass article 112*b* from the downstream line starwheel 104*d*. Beneficially, the takeup mechanism 168 can be used to dynamically adjust the distance traveled by the working side 166*a* of the conveyor 166. Such a dynamic adjustment can be used to compensate for stretching that may occur due to, e.g., heating or normal wear of the conveyor 166, or other inconsistencies in conveyor pitch distance, while maintaining the synchronization of the recirculation line 106 with the plurality of line starwheels 104.

Referring now to FIG. 2, a portion of the plurality of line starwheels 104 is illustrated. In the illustrated embodiment, each of the plurality of line starwheels 104 includes ten pockets 140 thereon. However, it is contemplated that the line starwheels 104 may include any suitable number of pockets. Each of the ten starwheel pockets 140 is configured to receive an article 110 at a predetermined stage of manufacture. In the illustrated example, the plurality of line starwheels 104 is configured to receive articles at five different stages of manufacture. As used herein, the articles 110 passing through the plurality of line starwheels 104 a first time are referred to as first-pass articles 112*a*, the articles 110 on a first recirculation and passing through the plurality of line starwheels 104 a second time and are referred to second-pass articles 112*b*, the articles 110 on a second recirculation and passing through the line starwheels 104 a third time are referred to as third-pass articles 112*c*, etc.

When passed through the plurality of line starwheels 104, all first-pass articles 112*a* will contact a first predetermined pocket of each line starwheel 104, all second-pass articles 112*b* will contact a second predetermined pocket of each line starwheel 104, all third-pass articles 112*c* will contact a third predetermined pocket of each line starwheel 104, all fourth-pass articles 112*d* will contact a fourth predetermined pocket of each line starwheel 104, and all fifth-pass articles 112*e* will contact a fifth predetermined pocket of each line starwheel 104. Because each line starwheel 104 of the illustrated embodiment includes ten starwheel pockets 140, each line starwheel 104 includes two pockets to receive articles from a respective pass. The two pockets for each respective pass are disposed generally opposite one another.

The illustrated portion of the plurality of line starwheels 104 of FIG. 2 includes forming starwheels 202*a, b* and transfer starwheels 204*a-c* disposed in a linear, alternating arrangement. Each of the line starwheels 104 rotates about a respective central axis. As illustrated by directional arrows D, adjacent line starwheels 104 in the plurality of starwheels counter rotate. The transfer starwheels 204*a-c* are configured to load, unload, and pass the articles 110 downstream without performing a modifying operation.

The forming starwheels 202*a, b* are disposed on a forming turret (not shown). The forming turret may perform any suitable type of forming operation or process on the articles 110. For example, the forming turret may perform a necking, curling, trimming, threading, expanding, heating, or any other suitable type of operation. Adjacent starwheel pockets 140 of a forming starwheel 202*a, b* may perform different operations. For example, an article 110 in a first starwheel pocket 140 of the forming starwheel 202*a,b* may undergo a necking step while an article 110 in a second starwheel pocket 140 of the forming starwheel 202, adjacent the first starwheel pocket 140, may undergo an expanding step. Additionally, one or more starwheel pockets 140 of the forming starwheels 202*a, b* may be configured to transfer the article 110 without performing a modifying operation on the article 110.

During operation, the first transfer starwheel 204*a* loads the articles 110 into the first forming starwheel 202*a* that is adjacent to and downstream from the first transfer starwheel 204*a*. The first forming starwheel 202*a* then performs a forming operation on the articles 110 while continually rotating. The forming operation is completed within a working angle of the forming starwheel. In the illustrated example, the working angle of the first forming starwheel 202*a* is 180°, or one-half revolution of the first forming starwheel 202*a*. It is contemplated that other working angles may be used. A second transfer starwheel 204*b* that is adjacent to and downstream from the first forming starwheel 202*a* then unloads the articles 110 from the first forming starwheel 202*a*. The second transfer starwheel 204*b* then transfers the articles 110 to the second forming starwheel 202*b* that is adjacent to and downstream from the second transfer starwheel 204*b*. The second forming starwheel 202*b* then performs an additional forming operation on the articles 110 while continually rotating. A third transfer starwheel 204*c* that is adjacent to and downstream from the second forming starwheel 202*b* then unloads the article 110 from the second forming starwheel 202*b* and passes the article 110 downstream to be recirculated and/or to have further forming operations performed.

By way of example, the passage of a single article 110 through the system 100 will be described. FIG. 3 illustrates an expanded view of the interfaces between the plurality of line starwheels 104 and the recirculation line 106 within the system 100. The infeed starwheel 102 engages a preform article 312 and feeds the preform article 312 into a first-pass starwheel pocket 140 of the upstream line starwheel 104*u* of the plurality of line starwheels 104. In the illustrated example, the upstream line starwheel 104*u* is a transfer starwheel 204. The preform article 312 is then passed between the corresponding first-pass starwheel pocket 140 of each of the plurality of line starwheels 104. At least one of the first-pass pockets 140 of the line starwheels 104 applies a forming operation such as necking, expanding, trimming, etc. to form a first-pass article 112*a*. After reaching a downstream line starwheel 104*d*, the first-pass article 112*a* is received by the first line pocket 172*a*. The first-pass article 112*a* is then transported along the working side 166*a* of the conveyor 166 and phase shifted so that the first-pass article 112*a* is deposited in a second-pass starwheel pocket 140 of the upstream line starwheel 104*u* for a first recirculation.

The first-pass article 112*a* is then passed between the corresponding second-pass starwheel pocket 140 of each of the plurality of line starwheels 104. At least one of the second-pass pockets 140 of the line starwheels 104 applies a forming operation to form a second-pass article 112*b*. After reaching the downstream line starwheel 104*d*, the second-pass article 112*b* is received by the second line pocket 172*b*. The second-pass article 112*b* is then transported along the working side 166*a* of the conveyor 166 and phase shifted so that the second-pass article 112*b* is deposited in a third-pass starwheel pocket 140 of the upstream line starwheel 104*u* for a second recirculation.

The second-pass article 112*b* is then passed between the corresponding third-pass starwheel pocket 140 of each of the plurality of line starwheels 104. At least one of the third-pass pockets 140 of the line starwheels 104 applies a forming operation to form a third-pass article 112*c*. After reaching the downstream line starwheel 104*d*, the third-pass article 112*c* is received by the third line pocket 172*c*. The third-pass article 112*c* is then transported along the working side 166*a* of the conveyor 166 and phase shifted so that the third-pass article 112*c* is deposited in a fourth-pass starwheel pocket 140 of the upstream line starwheel 104*u* for a third recirculation.

The third-pass article 112*c* is then passed between the corresponding fourth-pass starwheel pocket 140 of each of the plurality of line starwheels 104. At least one of the fourth-pass pockets 140 of the line starwheels 104 applies a forming operation to form a fourth-pass article 112*d*. After reaching the downstream line starwheel 104*d*, the fourth-pass article 112*d* is received by the fourth line pocket 172*d*. The fourth-pass article 112*d* is then transported along the working side 166*a* of the conveyor 166 and phase shifted so that the fourth-pass article 112*d* is deposited in a fifth-pass starwheel pocket 140 of the upstream line starwheel 104*u* for its fourth recirculation.

The fourth-pass article 112*d* is then passed between the corresponding fifth-pass starwheel pocket 140 of each of the plurality of line starwheels 104. At least one of the fifth-pass pockets 140 of the line starwheels 104 applies a forming operation to form a fifth-pass article 112*e*. After reaching the downstream line starwheel 104*d*, the fifth-pass article 112*e* is received by the outfeed starwheel 108. The outfeed starwheel 108 then passes the fifth-pass articles 112*e* to downstream processes for further modification or packaging.

Beneficially, the first takeup idler 168*a* and the second takeup idler 168*b* of the system 100 allow for modularity of the recirculation line 106. That is, the line starwheels 104 between the upstream line starwheel 104*u* and the downstream line starwheel 104*d* can be housed within a plurality of modular units. When modules are added to or removed from the system 100, sections of conveyor 166 equal to about twice the module width will generally be added or removed from the recirculation line 106. The first takeup idler 168*a* and the second takeup idler 168*b* can then be adjusted to accommodate for the addition or subtraction of these modular units to the system 100 while maintaining the proper synchronization and phase shift. This configurability benefits users by reducing the cost and time associated with system modification. Additionally, this configurability benefits the manufacturer by reducing the amount of different parts needed to provide a variety of systems. It is contemplated that the first takeup idler 168*a* and the second takeup idler 168*b* can be configured to accommodate for the addition or subtraction of at least one modular unit without the need to add or remove sections of the conveyor 166.

While the above-described system 100 includes forming starwheels 202 with ten pockets thereon, it is contemplated that other numbers may be used. The number of recirculations possible in such a system is determined by the number of pockets on the forming starwheels. That is, the number of passes is a factor of the number of starwheel pockets. For example, a system having ten-pocket line starwheels can accommodate one, two, five, or ten passes through the line starwheels. In another example, a system having twelve-pocket forming starwheels can accommodate one, two, three, four, six, or twelve passes through the line starwheels.

The number of stages needed to achieve a desired modification of an article is generally constant, so increasing the number of passes performed by a single system allows the total number of line starwheels to be reduced. For example, a single-pass system may require 50 line starwheels to achieve the desired modification, whereas a five-pass system may require only 10 line starwheels to achieve that same modification. It is contemplated that certain processing or machine limitations may slightly increase the minimum number of starwheels needed. It is further contemplated that some systems may employ only a single line starwheel and recirculate the articles between pockets of the starwheel.

While the above-described system 100 includes a generally linear configuration of the line starwheels 104, it is contemplated that different configurations may be used. For example, in some embodiments, the line starwheels 104 are arranged in a non-linear configuration such as that described in U.S. Pat. Publ'n No. 2010/0212393, U.S. Pat. Publ'n No. 2010/0212394, and/or U.S. Pat. Publ'n No. 2013/0149073, each of which is incorporated herein by reference in its entirety.

While the above-described system 100 controls the linear distance traveled by the working side 166*a* to phase shift the articles 110, it is contemplated that different methods may be used. For example, phase shifting the articles can be effected by changing the angle of a first line defined by the central axis of the head pulley 162 and the central axis of the upstream line starwheel 104*u* relative to a second line defined by the central axis of the tail pulley 164 and the downstream line starwheel 104*d*. For example, in a ten-pocket starwheel system, if the second line is disposed vertically (e.g., the tail pulley 164 picks up articles 110 at top-dead-center of the downstream starwheel 104*d*) and the first line is disposed 36° counter-clockwise from vertical (top-dead-center), then the recirculation line 106 to receives a third-pass article 112*c* from the third-pass starwheel pocket 140 of the downstream line starwheel 104*d* while contemporaneously depositing a different third-pass article 112*c* in the fourth-pass starwheel pocket 140 of the upstream line starwheel 104*u*. The 36° is determined by a full rotation, 360°, divided by the number of pockets, which in the illustrated embodiment is 10. The phase shift may also be accomplished using mechanical phasing devices such as clamping hubs, differential gearing, slotted hubs, indexing heads, etc. or electronic phasing mechanisms such as control systems for servo-driven pulleys. It is contemplated that possible methods of phase shifting may be used alone or combination to achieve the desired result.

While the above-described system 100 is arranged with the starwheels 202*a, b* having axes that are disposed generally horizontally, it is contemplated that the starwheels 202*a, b* may be oriented to have axes that are disposed generally vertically. Similarly, while the above-described recirculation line 166 is oriented generally in a vertical plane, it is contemplated that the recirculation line 166 may be oriented along a horizontal plane. Moreover, while the above-described recirculation line 166 travels generally along two dimensions, it is contemplated that the recirculation line 166 may travel through three dimensions. Beneficially, traveling through three dimensions can be used to reduce the overall space (e.g., height) occupied by the machine line.

While the above-described system 100 includes a serial arrangement of starwheel pockets 140, it is contemplated that other configurations may be used, for example, where the preceding-pass pocket is not adjacent the subsequent-pass pocket.

Each of these embodiments and obvious variations thereof is contemplated as falling within the spirit and scope of the claimed invention, which is set forth in the following claims. Moreover, the present concepts expressly include any and all combinations and sub-combinations of the preceding elements and aspects.

The invention claimed is:

1. A system for modifying articles received from an infeed, the system comprising:

a plurality of line starwheels being cooperatively arranged to form a process line, each of the plurality of line starwheels including a plurality of starwheel pockets thereon, the plurality of starwheel pockets including a first-pass starwheel pocket, a second-pass starwheel pocket, and a third-pass starwheel pocket; and a recirculation line including a synchronization mechanism and a plurality of line-pocket sets, each of the plurality of line-pocket sets including a first line pocket and a second line pocket, the first line pocket configured to receive an article from the first-pass starwheel pocket of a downstream line starwheel and deposit the article in the second-pass starwheel pocket of an upstream line starwheel, the second line pocket configured to receive the article from the second-pass starwheel pocket of the downstream line starwheel and deposit the article in the third-pass starwheel pocket of the upstream line starwheel, the synchronization mechanism configured to synchronize the plurality of line-pocket sets to the plurality of starwheel pockets, wherein the article contacting the first-pass starwheel pockets, the second-pass starwheel pockets, and the third-pass starwheel pockets corresponds with a respective first stage, second stage, and third stage of modifying the article, the first stage, the second stage, and the third stage corresponding with different stages of manufacture.

2. The system of claim 1, further comprising a takeup mechanism operatively engaging the recirculation line, the takeup mechanism including a first takeup idler on a working side of the recirculation line, the first takeup idler being reconfigurable to modify the linear distance traveled by articles on the working side of the recirculation line.

3. The system of claim 2, wherein the takeup mechanism further includes a second takeup idler on a return side of the recirculation line, the second takeup idler being reconfigurable to maintain a desired level of tension on the return side of the recirculation line.

4. The system of claim 1, wherein the synchronization mechanism mechanically links the recirculation line to plurality of line starwheels.

5. The system of claim 1, wherein the synchronization mechanism includes servo motors to synchronize the recirculation line to the plurality of line starwheels.

6. The system of claim 1, further comprising an outfeed starwheel configured to receive the article from the downstream line starwheel after the article has passed through the plurality of line starwheels at least three times.

7. The system of claim 1, wherein the recirculation line further includes a head pulley and a tail pulley, the head pulley being configured to operatively engage the recirculation line with the upstream line starwheel, the tail pulley being configured to operatively engage the recirculation line with the downstream line starwheel, and wherein rotation of the head pulley is synchronized with rotation the upstream starwheel and rotation of the tail pulley is synchronized with rotation of the downstream starwheel, the rotation synchronization being determined at least in part using the linear distance traveled by the article while on the working side of the recirculation line.

8. The system of claim 1, wherein the plurality of starwheel pockets further includes a fourth-pass starwheel pocket and a fifth-pass starwheel pocket, wherein each of the plurality of line-pocket sets further includes a third line pocket and a fourth line pocket, the third line pocket configured to receive the article from the third-pass starwheel pocket of the downstream line starwheel and deposit the article in the fourth-pass starwheel pocket of the upstream line starwheel, the fourth line pocket configured to receive the article from the fourth-pass starwheel pocket of the downstream line starwheel and deposit the article in the fifth-pass starwheel pocket of the upstream line starwheel, and wherein the article further contacts a fourth-pass starwheel pocket and a fifth-pass starwheel pocket corresponding to a respective fourth stage and fifth stage of modifying the article.

9. The system of claim 1, wherein the first-pass starwheel pocket, the second-pass starwheel pocket, and the third-pass starwheel pocket that correspond to the respective first stage, second stage, and third stage of modifying the article are disposed about a single line starwheel in the plurality of line starwheels.

10. The system of claim 1, wherein the number of stages of modifying the article corresponds with the total number of starwheel pockets of the plurality of line starwheels.

11. A method of modifying articles comprising:

providing an article to be modified to a plurality of line starwheels, each of the plurality of line starwheels including a plurality of starwheel pockets thereon, the plurality of pockets including a first-pass starwheel pocket, a second-pass starwheel pocket, and a third-pass starwheel pocket;

modifying, using the first-pass starwheel pocket of at least one of the line starwheels, the article to form a first-pass article;

transferring, using a first line pocket of a recirculation line, the first-pass article from the first-pass starwheel pocket of a downstream line starwheel to the second-pass starwheel pocket of an upstream line starwheel, the first-pass article traveling along a path defining a working side of the recirculation line;

modifying, using the second-pass starwheel pocket of at least one of the line starwheels, the first-pass article to form a second-pass article;

transferring, using a second line pocket of the recirculation line, the second-pass article from the second-pass starwheel pocket of the downstream line starwheel to the third-pass starwheel pocket of the upstream line starwheel, the second-pass article traveling along the working side of the recirculation line; and tensioning, using a takeup mechanism, the working side of a conveyor of the recirculation line and a return side of the conveyor of the recirculation line, wherein the first-pass article and the second-pass article correspond with different stages of manufacture.

12. The method of claim 11, wherein the takeup mechanism includes a first takeup idler engaging the working side of the recirculation line, and a second takeup idler engaging the return side of the recirculation line.

13. The method of claim 11, wherein the acts of modifying the article to form the first-pass article and the second-pass article are performed using the first-pass starwheel pocket and the second-pass starwheel pocket of a single line starwheel.

14. The method of claim 11, further comprising:

modifying, using the third-pass starwheel pocket of at least one of the line starwheels, the article to form a third-pass article;

transferring, using a third line pocket of the recirculation line, the third-pass article from the third-pass starwheel pocket of the downstream line starwheel to a fourth-pass starwheel pocket of the upstream line starwheel;

modifying, using a fourth-pass starwheel pocket of at least one of the line starwheels, the first-pass article to form a fourth-pass article; and transferring, using a fourth line pocket of the recirculation line, the fourth-pass article from the fourth-pass starwheel pocket of the downstream line starwheel to a fifth-pass starwheel pocket of the upstream line starwheel.

15. The method of claim 11, further comprising:

modifying, using at least the third-pass starwheel pocket of at least one of the line starwheels, the second-pass article to form a processed article; and transferring the processed article from the downstream line starwheel to an outfeed from the plurality of line starwheels.

16. The method of claim 11, wherein the act of tensioning the working side of the recirculation line includes selecting a linear distance to be spanned by the working side of the recirculation line, the selected linear distance effecting a phase shift between the downstream starwheel and the upstream starwheel.

17. The method of claim 11, further comprising:

synchronizing a head pulley of the recirculation line with the upstream line starwheel and a tail pulley of the recirculation line with the downstream line starwheel, the head pulley being configured to operatively engage the recirculation line with the upstream line starwheel, the tail pulley being configured to operatively engage the recirculation line with the downstream line starwheel.

18. The method of claim 17, wherein the synchronizing is determined at least in part using the linear distance traveled by the article on the working side of the recirculation line.

19. The method of claim 11, wherein the number of times the article is transferred to a subsequent-pass starwheel pocket of the downstream line starwheel is a factor of the number of starwheel pockets on each of the plurality of line starwheels.

20. A system for modifying articles, the system comprising:

an infeed starwheel configured to supply preformed articles at regular intervals;

one or more line starwheels, each of the one or more line starwheels including a plurality of starwheel pockets thereon, the one or more line starwheels including a first pocket, a second pocket, and a third pocket, the first pocket configured to receive the preformed articles from the infeed starwheel and perform a first modification producing first-pass articles, the second pocket configured to receive the first-pass articles and perform a second modification producing second-pass articles, the third pocket configured to receive the second-pass articles and perform a third modification creating third-pass articles;

a recirculation line configured to receive the first-pass articles and the second-pass articles, the recirculation line being further configured to transport the first-pass articles and the second-pass articles, each of the first-pass articles and the second-pass articles being phase shifted during transport; and an outfeed starwheel configured to remove completed articles from one of the one or more line starwheels at regular intervals, the completed articles having been modified by the first pocket, the second pocket, and the third pocket, wherein the first modification, the second modification, and the third modification correspond with different stages of manufacture.

21. The system of claim 20, wherein the distance traveled by the first-pass articles and the second-pass articles is selected to effect the phase shift.

22. The system of claim 20, further comprising a synchronization mechanism, the synchronization mechanism being configured to control a speed and phase of the modified articles.

23. The system of claim 20, wherein the number of modifications corresponds with the total number of starwheel pockets of the one or more line starwheels.

* * * * *